United States Patent [19]

Oelschläger

[11] Patent Number: 4,645,033

[45] Date of Patent: Feb. 24, 1987

[54] STRAP SEAT

[75] Inventor: Hans H. Oelschläger, Bücken, Fed. Rep. of Germany

[73] Assignee: Heinrich Oelschläger Metallwarenfabrik, Hoya, Fed. Rep. of Germany

[21] Appl. No.: 693,093

[22] Filed: Jan. 22, 1985

[30] Foreign Application Priority Data

Jan. 23, 1984 [DE] Fed. Rep. of Germany ..... 3402162

[51] Int. Cl.[4] ..... A62B 35/00

[52] U.S. Cl. ..... 182/6; 244/151 R

[58] Field of Search ..... 182/3-7, 182/237; 244/151 R; 119/96, 101

[56] References Cited

U.S. PATENT DOCUMENTS

| | | | |
|---|---|---|---|
| 416,550 | 12/1889 | Betten | 182/6 |
| 2,464,719 | 3/1949 | Quilter | 244/151 R |
| 2,979,153 | 4/1961 | Hoagland | 182/3 |
| 3,176,793 | 4/1965 | Hlacia | 182/3 |
| 4,410,175 | 10/1983 | Shamp | 182/6 |
| 4,452,339 | 6/1984 | Raymaker | 182/232 |
| 4,512,437 | 4/1985 | Savage | 182/3 |

FOREIGN PATENT DOCUMENTS

| | | | |
|---|---|---|---|
| 210758 | 1/1960 | Austria | 182/3 |
| 1189863 | 1/1960 | Fed. Rep. of Germany | 244/151 R |
| 2464084 | 6/1981 | France . | |
| 352568 | 9/1937 | Italy | 244/151 R |
| 119157 | 11/1944 | United Kingdom | 244/151 R |
| 826786 | 1/1960 | United Kingdom . | |

*Primary Examiner*—Reinaldo P. Machado
*Assistant Examiner*—Alvin Chin-Shue
*Attorney, Agent, or Firm*—Kenyon & Kenyon

[57] ABSTRACT

A strap seat, utilizable in particular by persons descending on a rope by means of a rope payout device, comprises a pair of carrying bands having upper ends connected to one another at a junction or overlap point and lower ends folded back upon themselves to form a pair of leg loops. The carrying bands are firmly attached at their overlap point to a pair of trousers and are guided substantially along an upper edge of the trousers through openings or loops in a triangular extension of the trousers. The bottoms of the trouser legs are closed, while the carrying bands are attached to the upper ends of the trouser legs in the crotch area of the trousers. A rope payout device is connectable to the strap seat at the overlap point of the carrying bands.

19 Claims, 3 Drawing Figures

STRAP SEAT

BACKGROUND OF THE INVENTION

This invention relates to a strap seat couplable to a rope payout device and utilizable by persons descending on a rope connected to the payout device.

As described in German Patent Document (Deutsche Offenlegungsschrift) No. 29 30 570, such a strap seat comprises two carrying bands, the lower ends of which are folded back on themselves to form leg loops and which are joined together by means of two crossing dorsal bands. A rope payout device is releasably attachable to a receiving device on the strap seat. As stated in the Offenlegungsschrift, such strap seats should be convenient and safe to use, profitable to manufacture and market, and easily to apply quickly even in tense and exciting situations. Conventional strap seats satisfy these requirements to a limited extent only.

Conventional strap seats fail to adequately promote feelings of safety and security, particularly when a person is descending from a great height. In addition, there is no assurance in conventional seats that the seat will always be stepped into correctly, i.e., with the user's legs extending through respective leg loops. The failure to properly apply a strap seat greatly increases the chances of falling. In order to facilitate the correct donning of a strap seat, conventional strap seats are necessarily provided with special markings, for example, to distinguish the leg loops from the dorsal straps. In the excitement of the situation, these special markings may be misread or ignored.

An object of the present invention is to provide an especially safe, improved strap seat of the above-described A more particular object of the present invention is to provide such a strap seat which enhances feelings of safety and security in a user.

Another particular object of the present invention is to provide such a strap seat which is readily utilizable by persons of different sizes and weights.

SUMMARY OF THE INVENTION

In accordance with the present invention, a strap seat comprise a pair of trousers having a front side, a back side opposite thereto, an upper edge and two trouser legs contiguous with one another at a crotch area. Two carrying bands have lower ends folded back on themselves to form a pair of leg loops which pass through the crotch area of the trousers and encircle respective ones of the trouser legs at upper portions thereof. The carrying bands are firmly connected to the pair of trousers and have upper ends fastened to one another at an overlap point of the bands on the front side of the trousers. The trousers are provided with securing means for displaceably guiding the bands along the upper edge of the trousers. Two dorsal bands cross one another at the backside of the trousers and join the carrying bands to one another. A connector is provided at the overlap point of the carrying bands for releasably attaching a rope payout device to the strap seat.

A strap seat in accordance with the invention at least reduces the likelihood of, and may totally preclude, incorrect handling because a person steps into such a strap seat as into a pair of trousers. The trouser design conveys a substantial feeling of safety and in addition serves to protect women wearing skirts or dresses from leg injury during the descending process.

In accordance with a particular feature of the present invention, the pair of trousers converges on the front side from the waist upwardly to the junction of the two carrying bands. Thus, the pair of trousers includes on the front side a substantially triangular portion extending from the waist region to the overlap point of the carrying bands. Owing to this feature of the strap seat, a user who has gotten ill can lean over forwardly during a descent without running the risk of falling out of the strap seat. The high front of the trousers blocks the downward view and may thereby serve to prevent dizziness. Finally, the raised front portion of the trousers makes its possible to distribute over a relatively large area the forces transmitted by the carrying bands, so that the carrying bands do not cut into the skin.

In accordance with another particular feature of the present invention, the trianbular portion of the pair of trousers has a pair of converging edges, the securing means including openings in the triangular portion proximate to the converging edges thereof. Because of the simplicity of design, the openings in the triangular portion are preferred to additional holding devices such as loops.

In accordance with yet another particular feature of the present invention, the front side of the pair of trousers is fastened to the carrying bands at the overlap point thereof. Thus, a single seam suffices to connect the trousers to both carrying bands. The point of attachment is made at an apex of the triangular portion spaced from the waist region of the trousers.

In order to distribute the forces of the dorsal bands evenly, both dorsal bands are advantageously attached to the trousers in the region of the junction or overlap point of the two carrying bands. Preferably, the dorsal bands are firmly connected to the carrying bands at the overlap point thereof. In this manner, the forces transmitted through the trousers, the carrying bands and the dorsal bands may be guided uniformly to a receiving hook for a rope payout device at the overlap point or junction of the carrying bands.

Pursuant to a particular feature of the present invention, an extension band has a first end firmly joined to the carrying bands at the overlap point or junction thereof and a receiving device is attached to the extension band at a second end thereof opposite the overlap point.

The extension band may be made of the same material as the carrying bands, while the connector advantageously includes a plurality of receiving devices attached to the extension band and spaced from one another therealong. The extension band, together with the plurality of receiving devices, enables the strap seat to be used by persons of different sizes. The rope payout device can be hooked by a user of the strap seat to one of the receiving devices in accordance with the size of the user.

Pursuant to another particular feature of the present invention, the carrying bands are sewn to the pair of trousers at the crotch area thereof. Each leg loop is advantageously sewn to the trousers separately from the other leg loop and on an opposite side of the crotch area therefrom.

Pursuant to yet other particular features of the present invention, the carrying bands are provided on an inner side with padding in the region of the leg loops, the padding being a foam material laterally projecting beyond the longitudinal edges of the carrying bands and attached to the carrying bands along longitudinal seams extending approximately along center lines of the carrying bands. The lateral projecting of a foam material beyond the longitudinal edges of the carrying bands is especially effective to inhibit or prevent the leg loops from cutting into the legs of a user. The sewing of the padding along center lines of the carrying bands enables the foam material to exert its full padding effect in the edge regions of the carrying bands where the danger of cutting is especially extant. In addition, the stitching of the foam material along center lines of the carrying bands facilitates the manufacturing process, particularly when the sewing is done along a single seam.

Advantageously, each dorsal band is firmly attached to respective carrying band in the seat region of the trousers. Such a connection of the dorsal bands serves to hold the carrying bands together and also acts to channel over the dorsal bands some of the forces acting on the carrying bands. The dorsal bands preferably pass through a loop sewn onto the pair of trousers at the seat region thereof. The dorsal bands are used like conventional suspenders and are expediently adjustable in length.

In a particular embodiment of the present invention, the pair of trousers has a cut large enough to accommodate, for example, a large man wearing a large pair of pants. The large cut of the trousers assures that the strap seat can be used by anyone. Therefore, it is not necessary to determine a person's size prior to descent in a strap seat in accordance with the invention.

According to further features of the invention, the free ends of the trouser legs are closed, the dorsal bands consist of a material different in color from the carrying bands, and the strap seat is made of nonflammable material. The closing of the trouser legs at the bottoms thereof prevents a person from slipping through the strap seat, who, in panic at the thought of rappelling down the steep face of a cliff, mistakenly steps into one trouser leg only. The contrasting colors of the dorsal bands and carrying bands facilitate an immediate correlation and recognition of the appropriate functions. Because the trousers legs are closed at the bottom and the front portion of the trousers covers large parts of the body, a strap seat of nonflammable material serves as a protection against burns in situations where a person is forced to rappel through an area of fire.

DETAILED DESCRIPTION

Figure 1:
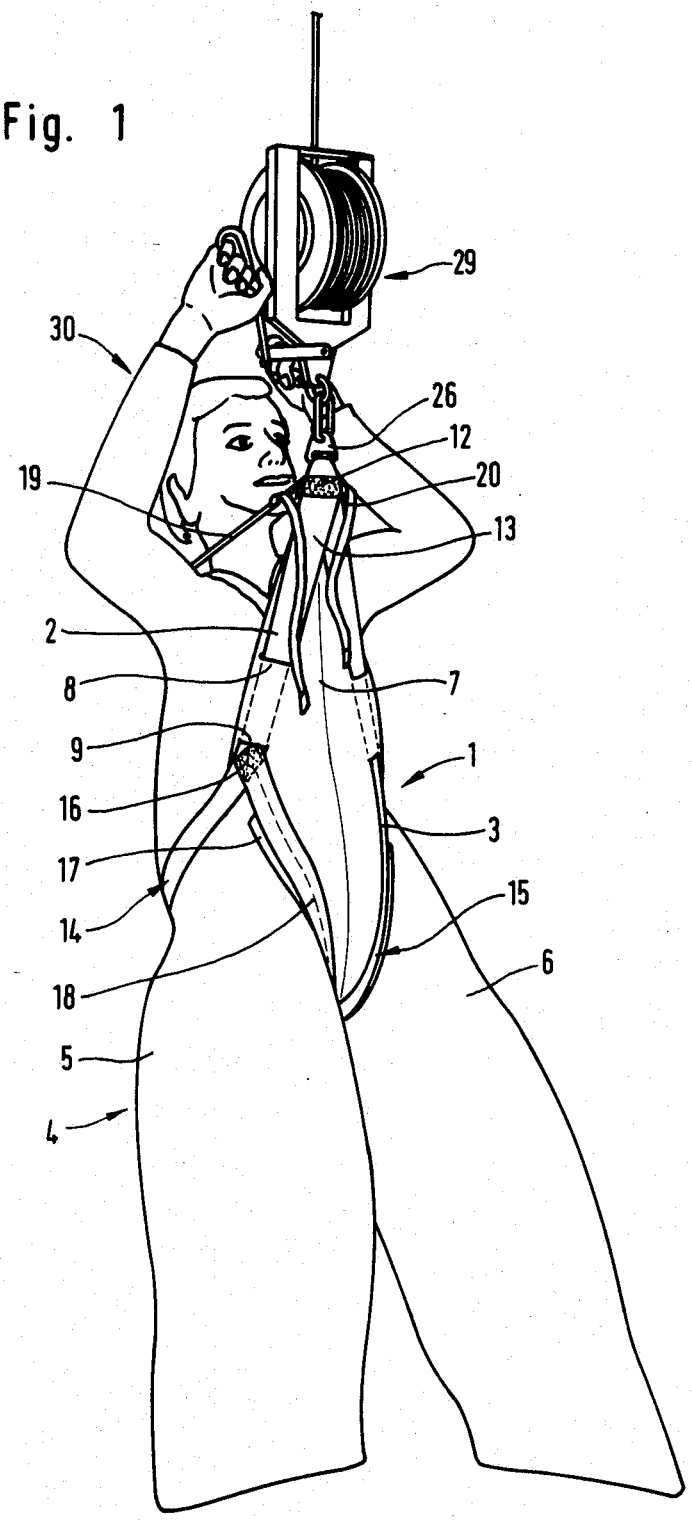
FIG. 1 is a partially schematic perspective view of a person supported by a strap seat in accordance with the present invention.

A strap seat 1 in accordance with the invention comprises a pair of carrying bands 2 and 3 of a textile fabric joined to a pair of trousers 4. The trousers 4 have a cut sufficiently large to accommodate a large man wearing a large pair of pants and include two trouser legs 5 and 6 each of which is sewn closed at the bottom end thereof. The upper ends of the trouser legs 5 and 6 are contiguous with one another in a crotch area 31 (see FIG. 3) of the pair of trousers.

The pair of trousers 4 has a front side with a triangular portion 7 extending from a waist region of the trousers 4 upwardly to an overlap point or junction 12 of carrying bands 2 and 3. Triangular portion 7 is defined in part by a pair of converging edges 32 and 33 which form part of an upper edge 34 of the pair of trousers. In the region of edge 32, triangular portion 7 is provided with a pair of openings or slits 8 and 9 through which carrying band 2 is displaceably guided. Similarly, triangular portion 7 is provided in the region of edge 33 with another pair of openings or slits 10 and 11 through which band 3 is displaceably guided. Openings 8–11 serve in part to secure carrying bands 2 and 3 proximatly to converging edges 32 and 33, respectively.

Extending along converging edges 32 and 33 of triangular portion 7, carrying bands 2 and 3 converge to overlap point 12 and are joined together at that point or junction. At overlap point 12 carrying bands 2 and 3 are also sewn to the upper end 13 of trousers 4. Carrying bands 2 and 3 have lower ends folded back and stitched to themselves (e.g., at a seam 16) to form a pair of leg loops 14 and 15.

To provide padding, each carrying band 2 and 3 is underlaid with foam material 17 having a width slightly greater than the width of the respective carrying band 2 or 3, whereby the foam material laterally projects beyond the longitudinal edges of the respective carrying band. The foam padding is attached to the respective carrying band 2 or 3 by means of a single longitudinal seam 18 (FIG. 1) extending approximately along the center line of the respective carrying band.

Each carrying band 2 and 3 is sewn to the pair of trousers at the crotch area 31 thereof. Thus, each carrying band 2 and 3 is attached to trousers 4 at two separate points, namely, at junction or overlap point 12 and at crotch 31. Preferably, leg loops 14 and 15 do not overlap one another at crotch area 31 and are separately stitched to the pair of trousers at the upper ends of trouser legs 5 and 6 and on opposite sides of crotch area 31.

Two dorsal bands 19 and 20 are connected to triangular portion 7 and to carrying bands 2 and 3 at overlap point or junction 12. Dorsal bands 19 and 20 are also connected at their lower ends 21 and 22 to carrying bands 3 and 2, respectively, in the seat region of trousers 4. Dorsal bands 19 and 20 traverse a loop 23 and cross one another in the region thereof, loop 23 being sewn onto trousers 4.

Figure 3:
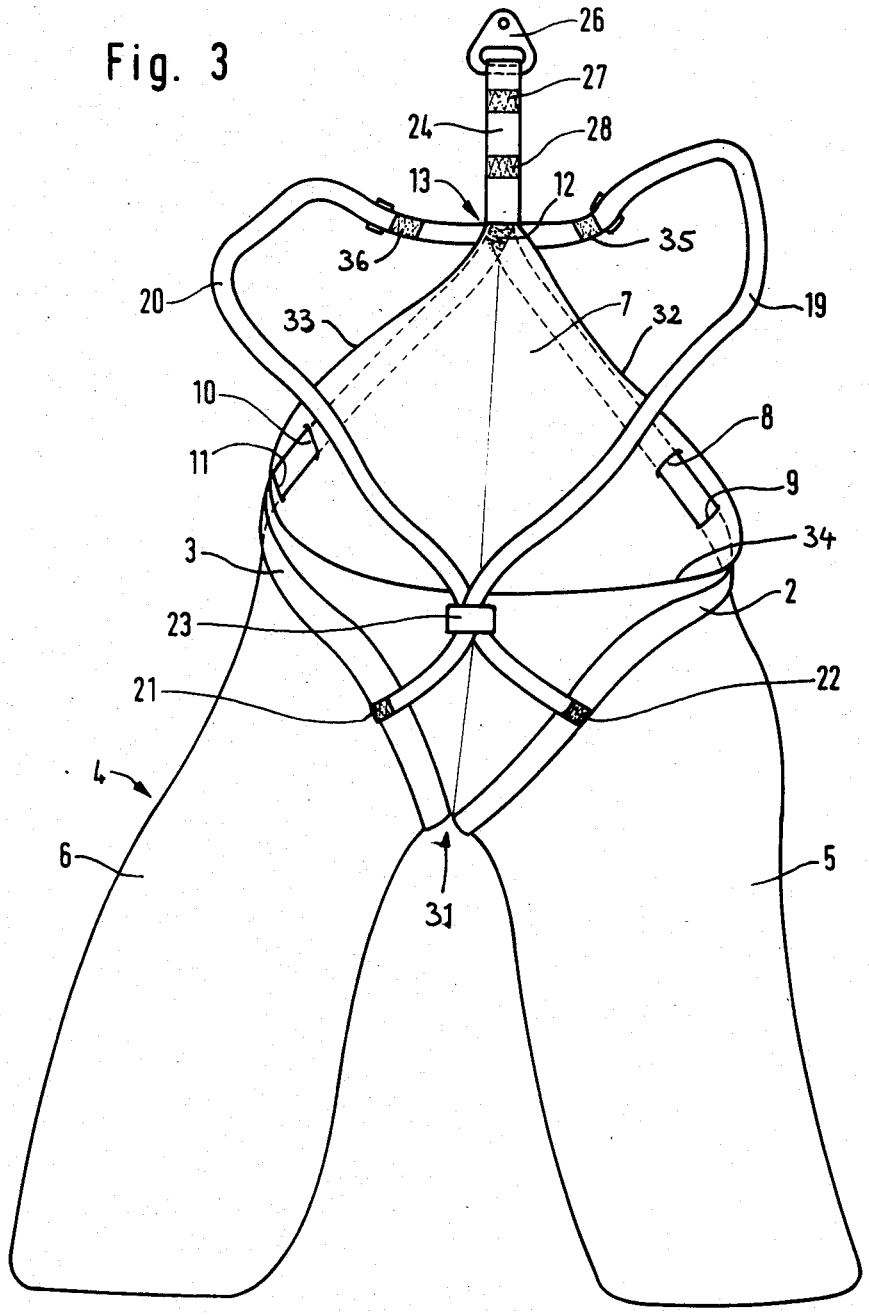
FIG. 3 is a back elevational view of the strap seat shown in FIGS. 1 and 2.

Dorsal bands 19 and 20, utilizable in the manner of suspenders, are each divided at their top ends into two sections held together by means of buckles 35 and 36 (see FIG. 3). Buckles 35 and 36 enable dorsal bands 19 and 20 to have adjustable lengths.

Figure 2:
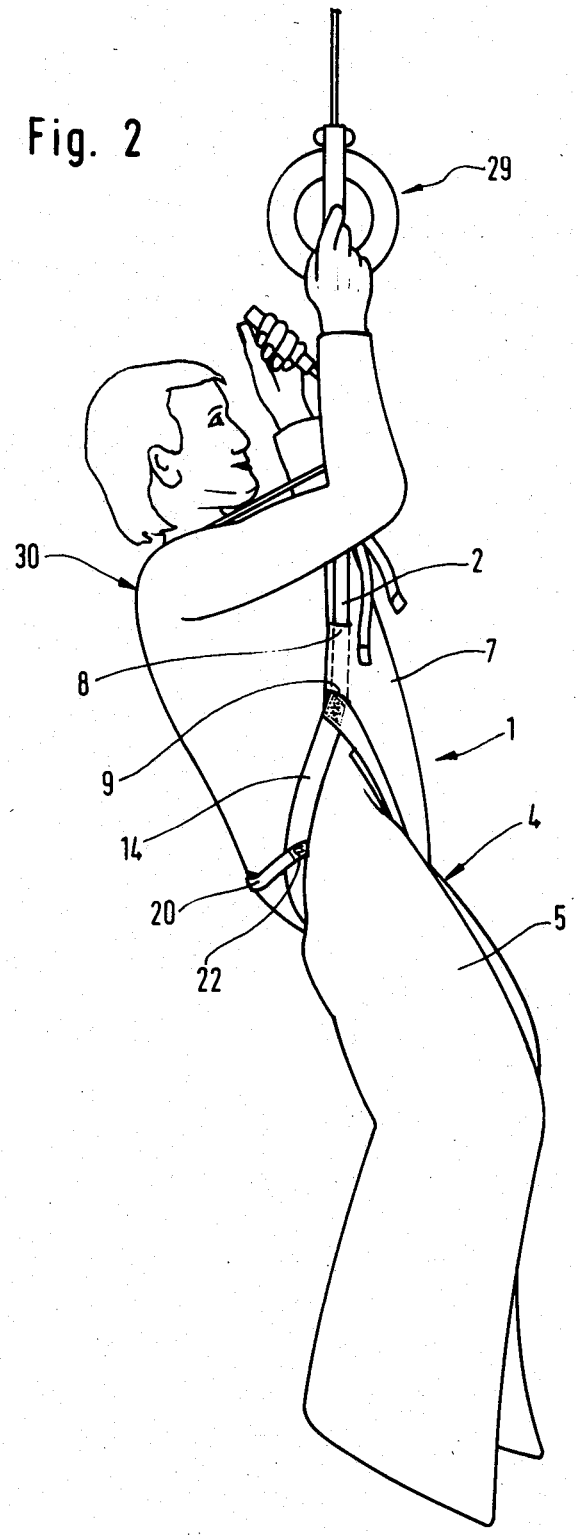
FIG. 2 is a partially schematic side elevational view of the person and the strap seat shown in FIG. 1.

At junction or overlap point 12, where carrying bands 2 and 3 as well as dorsal bands 19 and 20 are sewn to a apex of triangular portion 7, a first end of an extension band 24 is attached. An opposite end of extension band 24 is connected to a receiving device or hook 26 by means of which a rope payout device 29 (FIGS. 1 and 2) may be attached to the strap seat 1. Advantageously, extension band 24 also bears a plurality of additional receiving devices or hooks, schematically represented in FIG. 3 at reference numerals 27 and 28 and longitudinally spaced from one another and from receiving device 26 along the length of extension band 24. The rope payout device 29 is operated by a rapelling user 30, as illustrated in FIGS. 1 and 2.

In order to put strap seat 1 on, a user steps into trousers 4 and slips dorsal bands 19 and 20 over the shoulders in the manner of suspenders. Because carrying bands 2 and 3 pass outside of trouser legs 4 and 5 and are firmly connected to trousers 4 at crotch area 31 thereof, it is impossible not to step into at least one leg loop 14 or 15 when stepping into trousers 4. Upon stepping into trouser legs 5 and 6, a user need only connect a rope payout device 29 to one of the receiving devices 26, 27 or 28 by means of a spring safety hook or other element.

Dorsal bands 19 and 20, normally adjusted to an average body size, need be readjusted only for considerable deviations from the assumed average size.

Although the invention has been described in terms of particular embodiments and applications, one of ordinary skill in the art, in light of this teaching, can generate additional embodiments and modifications without exceeding the scope or departing from the spirit of the claimed invention. Accordingly, it is to be understood that the descriptions herein and the accompanying drawings are proffered by way of example to illustrate the invention and should not be construed to limit the scope thereof.

What is claimed is:

1. A strap seat comprising:

a pair of trousers having a front side, a back side opposite thereto, an upper edge and two trouser legs contiguous with one another at a crotch area;

two carrying bands having respective upper ends and respective lower ends, said lower ends of said bands being folded back on themselves, and fixedly attached to themselves, to form a pair of leg loops, said leg loops passing through said crotch area and encircling respective ones of said trouser legs at upper portions thereof, said upper ends of said bands being fastened to one another at an overlap point of said bands on said front side of said pair of trousers, said pair of trousers including on said front side a substantially triangular portion extending from a waist region of said pair of trousers to said overlap point of said carrying bands, a portion of said upper edge of said pair of trousers forming a pair of converging edges of said triangular portion, said carrying bands extending in part along said converging edges;

securing means on said pair of trousers for displaceably guiding said bands along said upper edge of said pair of trousers, said securing means including openings in said triangular portion proximate to said converging edges, said opening 6 being traversed by said carrying bands, said triangular portion having an apex spaced from the waist region of said pair of trousers, said apex of said triangular portion being fastened to said carrying bands at said overlap point;

two dorsal bands crossing one another at said back side of said pair of trousers and joining said carrying bands to one another; and connector means at said overlap point of said carrying bands for releaseably attaching a rope payout device to the strap seat.

2. The strap seat defined in claim 1, wherein said carrying bands are sewn to said pair of trousers at said crotch area.

3. The strap seat defined in claim 1, wherein said pair of trousers is cut large enough to accommodate a large man wearing a large pair of pants.

4. The strap seat defined in claim 1, wherein said trouser legs have free ends spaced from said crotch area, said trouser legs being closed at said free ends.

5. The strap seat defined in claim 1, wherein said dorsal bands have a common color and said carrying bands have a common color, the color of said dorsal bands being contrastingly different from the color of said carrying bands.

6. The strap seat defined in claim 1, wherein said pair of trousers, said carrying bands and said dorsal bands are all made of nonflammable material.

7. The strap seat defined in claim 1, further comprising an extension band having a first end firmly joined to said carrying bands at said overlap point, said connector means including a receiving device attached to said extension band at a second end thereof opposite said first end.

8. The strap seat defined in claim 7 wherein said extension band is made of the same material as said carrying bands.

9. The strap seat defined in claim 7 wherein said connector means includes a plurality of receiving devices attached to said extension band and spaced from one another therealong.

10. The strap seat defined in claim 1, wherein said carrying bands are provided on an inner side with padding in the region of said leg loops.

11. The strap seat defined in claim 10 wherein carrying bands have longitudinal edges and wherein said padding is a foam material and laterally projects beyond said longitudinal edges.

12. The strap seat defined in claim 10 wherein said padding is attached to said carrying bands along longitudinal seams extending approximately along center lines of the carrying bands.

13. The strap seat defined in claim 1 wherein said dorsal bands are attached to said pair of trousers in the region of said overlap point of said carrying bands.

14. The strap seat defined in claim 13 wherein said dorsal bands are attached to said carrying bands at said overlap point.

15. The strap seat defined in claim 1 or 13 wherein said dorsal bands each have an adjustable length.

16. The strap seat defined in claim 1 or 13 wherein said pair of trousers has a seat portion and each dorsal band is firmly attached to a respective one of said carrying bands in the region of said seat portion.

17. The strap seat defined in claim 16 wherein said pair of trousers is provided with a loop in the region of said seat portion, said dorsal bands passing through said loop.

18. The strap seat defined in claim 1 or 13 wherein said pair of trousers has a seat portion and is provided with a loop in the region of said seat portion, said dorsal bands passing through said loop.

19. The strap seat defined in claim 18 wherein said loop is sewn onto said pair of trousers.

* * * * *

UNITED STATES PATENT AND TRADEMARK OFFICE

CERTIFICATE OF CORRECTION

PATENT NO. : 4,645,033

DATED : February 24, 1987

INVENTOR(S) : Hans Heinrich Oelschläger

It is certified that error appears in the above-identified patent and that said Letters Patent is hereby corrected as shown below:

Column 1, line 36, change "described" to --described type.--.

Column 2, line 19, change "trianbular" to --triangular--.

Column 4, line 14, change "imatly" to --imately--; line 57, change "a apex" to --an apex--.

Column 5, line 52, change "opening 6" to --openings--.

Signed and Sealed this

First Day of September, 1987

*Attest:*

*Attesting Officer*

DONALD J. QUIGG

*Commissioner of Patents and Trademarks*